United States Patent [19]

Lagerquist

[11] 4,340,005

[45] Jul. 20, 1982

[54] LUFF FEEDER ASSEMBLY FOR GROOVED JIBSTAY FOILS

[76] Inventor: Rolf E. Lagerquist, 1505 S. Oak, Lake City, Minn. 55978

[21] Appl. No.: 184,574

[22] Filed: Sep. 5, 1980

[51] Int. Cl.[3] ..... B63H 9/04

[52] U.S. Cl. ..... 114/105; 114/108

[58] Field of Search ..... 114/102–109, 114/111–115; 403/345, 359

[56] References Cited

U.S. PATENT DOCUMENTS

| | | | |
|---|---|---|---|
| 3,658,025 | 4/1972 | Hood et al. | 114/105 |
| 3,759,210 | 9/1973 | Davis | 114/105 |
| 3,802,373 | 4/1974 | Lagerquist | 114/105 |
| 3,851,609 | 12/1974 | Stearn | 114/105 |
| 3,948,200 | 4/1976 | Hood et al. | 114/105 |

FOREIGN PATENT DOCUMENTS

| | | | |
|---|---|---|---|
| 1340777 | 12/1973 | United Kingdom | 114/107 |

*Primary Examiner*—Edward R. Kazenske
*Assistant Examiner*—Stephen P. Avila
*Attorney, Agent, or Firm*—Jay C. Taylor; Neal A. Waldrop

[57] ABSTRACT

An assembly for feeding the luff of a jibsail into a grooved foil mounted on the headstay of a sailboat comprises a grooved feeder and prefeeder adapted to be removably mounted on the headstay. The feeder comprises a pair of interfitting spline members adapted to be assembled together by relative sliding movement along paired guideways to freely encircle the headstay and to confine the lower end of the foil therebetween and to be clamped to the latter and to each other as a unitary element by a single attachment means, such that the grooves of the feeder and foil are rigidly maintained in alignment. The prefeeder comprises a guide slidably and universally pivotal on the headstay at a location below the feeder and having a luff receiving opening through which the luff of the sail may be fed and guided to the grooved feeder and thence to the grooved foil. A pair of tubular spacers are removably secured to the headstay for sliding longitudinally thereon at locations above and below the prefeeder respectively for spacing the latter from the foil and for spacing the prefeeder from the lower attachment of the headstay with the boat, thereby also to provide means for supporting the foil with the attached feeder conveniently above the prefeeder and for supporting the latter conveniently above the lower end of the headstay, or its attachment adjacent the bow of the boat.

18 Claims, 8 Drawing Figures

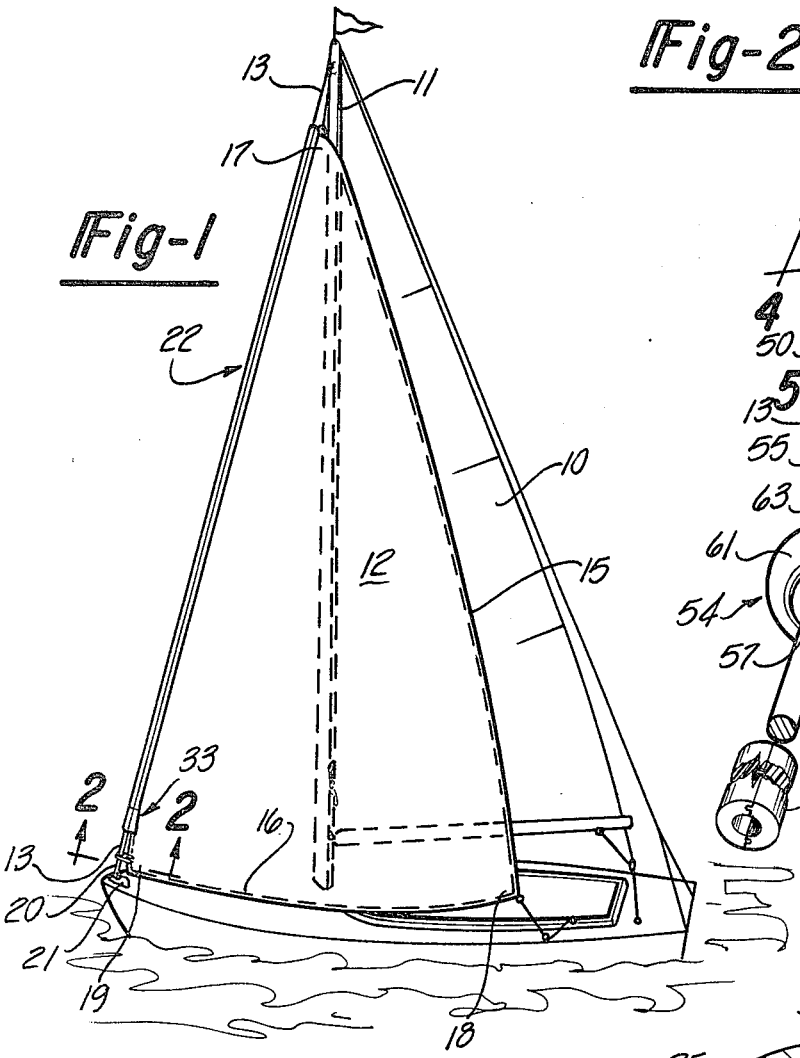
Fig-1
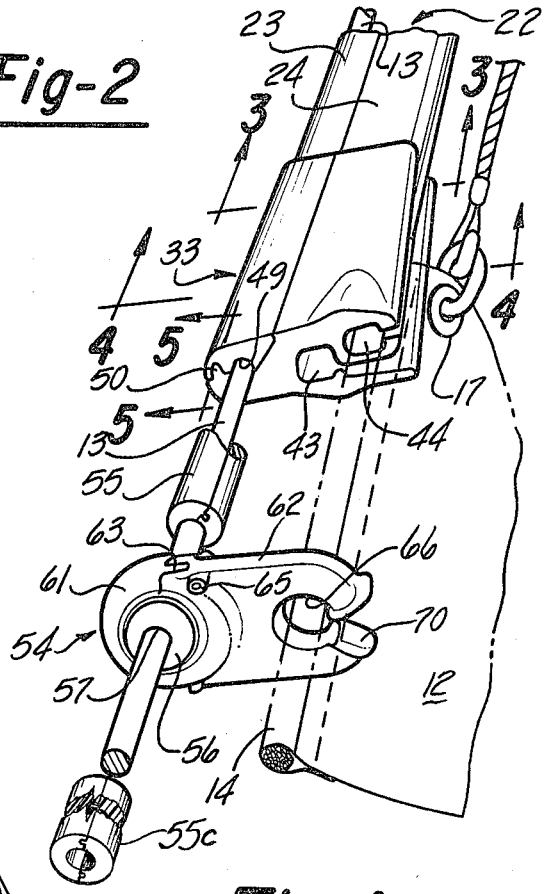
Fig-2
Fig-4
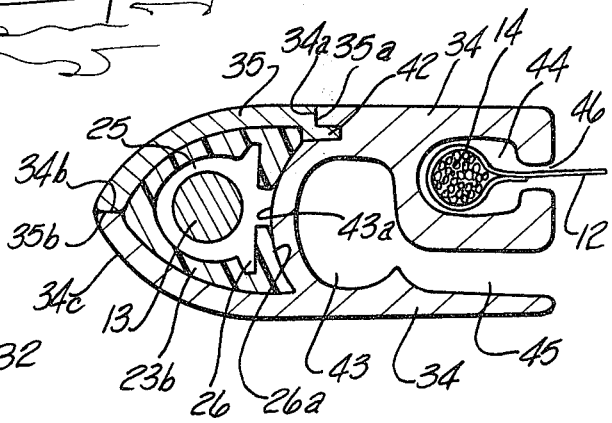
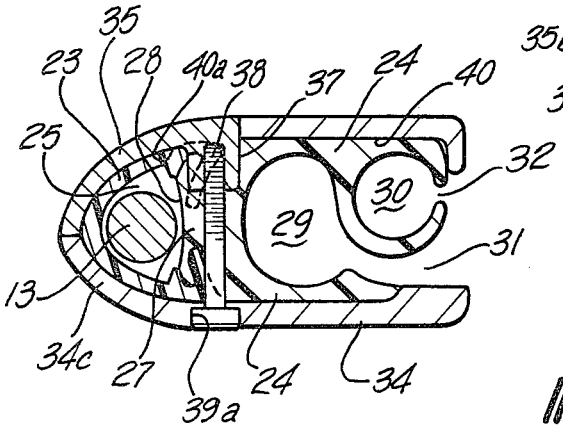
Fig-3
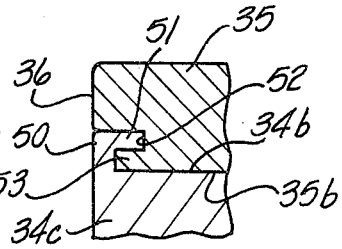
Fig-5

LUFF FEEDER ASSEMBLY FOR GROOVED JIBSTAY FOILS

BACKGROUND AND OBJECTS OF THE INVENTION

This invention relates to improved means for feeding the luff of a jibsail into a single or multi-grooved foil mounted on the jibwire, or rod, of a sailboat.

It has been conventional heretofore to provide jibsail or headstay foils having one or more luff retaining grooves or channels which extend longitudinally for substantially the length of the stay, whereby a second jibsail can be hoisted while the first is still set. The first sail can then be lowered, enabling continuous drive while changing sails. According to preference, the foil may be provided with a single groove adapted to retain the luff of one or more sails, or each luff may be retained in a separate groove of a multi-grooved foil. Various funnel type devices have been provided with varying degrees of acceptability to facilitate feeding of the luff into the grooved foil.

The expression foil, as used in this specification and in the claims, refers to an aerodynamically shaped sleeve device that fits over the jibstay and supports one or more sails. The jibstay, which may be a wire or rod, extends from the bow of the boat to near the top of the mast and the foil freely pivots about the jibstay wire or rod with the jibsail as it shifts under changing wind and boat directions. The expression luff feeder assembly refers to the luff feeder, prefeeder and spacer therebetween, as assembled on a sailboat to enable fast sail changing, as in racing. The luff feeder receives projecting end portions of a mating grooved foil and interlocks the foil portions together and to the luff feeder with a single screw to thereby form an integrated foil-feeder-assembly.

Important objects of the present invention are to provide a simple, effective, compact, easily assembled, and economically manufactured luff feeder or funnel assembly for slidably funneling the luff of a jibsail, for example, into a selected foil groove. More particularly it is an object to provide a luff feeder comparable to the grooved foil for receiving the luffs of one or more sails and comprising two major interfitting members that can be readily assembled by relative sliding movement; the feeder members also may be assembled around and secured to portions of a grooved foil by the same relative sliding movement and interlocked with the encircled foil by a single attachment means to hold the feeder and lower end of the grooved foil rigidly together as an integral unit and to maintain mating grooves of the feeder and foil in alignment regardless of bowing of the jibwire and twisting of the jibsail when under way.

Another object is to provide such a grooved luff feeder or funnel and grooved foil combination whereby optimum surface interengagement is obtained between the feeder and the lower end portions of the foil, thereby enabling the provision of a feeder assembly of minimum length longitudinally of the jibwire.

A pair of tubular spacers are removably secured to the headstay for sliding longitudinally thereon at locations above and below the prefeeder respectively to space the latter from the foil and to space the prefeeder from the lower attachment of the headstay with the boat, thereby also to provide means for supporting the foil with the attached feeder conveniently above the prefeeder and for supporting the latter conveniently above the lower end of the headstay attachment adjacent the bow of the boat, such that attachment of either the feeder or prefeeder at a fixed position on the headstay is avoided and feeding of the luff of a sail into the grooved foil is facilitated.

Another object is to provide an improved prefeeder device for assisting the feeding of the luff of a sail into the lower funnel end of the feeder, wherein the prefeeder device is likewise of simple economical construction, yet readily removably supportable on the stay for limited universal pivotal movement thereon at an operative location spaced from the luff feeder and effectively maintained against accidental detachment from the jibwire or headstay.

Another and more specific object is to provide such a prefeeder device which is universally pivotal on a spherical retainer slidably secured to the headstay. The spherical retainer comprises two halves defining a diametrical bore therebetween for slidable passage of the headstay and adapted to be separably snapped together at a diametrical plane by means of interfitting pin and socket elements. The two spherical halves are prevented from accidental separation by means of a two part zonal housing loosely encircling an equatorial portion of the retainer. The interior surface of the housing is spherical to effect the universal pivoting. The two parts of the housing meet at diametrically opposite locations and are keyed together by spring pins resiliently interfitting within aligned pin holes through overlapping portions of the housing parts adjacent each of the diametrically opposite locations. One of the housing parts extends radially from the retainer and is provided at its outer end with a conventional luff prefeed opening.

By virtue of the foregoing, the two retainer halves and the keyed connections may be similar, thus simplifying inventory and also simplifying replacement of worn or lost parts. In the event it is necessary to replace the spherical retainer, one of the spring pins can be removed axially from its aligned pinholes, whereupon the remaining pin serves as a hinge axis enabling the housing parts to be swung to an open position for removal and replacement of the spherical retainer.

THE PRIOR ART

The most pertinent art known to applicant is his own prior U.S. Pat. No. 3,802,373, over which the present invention is an improvement. No art is known to applicant that achieves the compact feeder assembly combination described herein comprising specifically the feeder sliding assembly via interlocking splines, and the universally pivotal prefeeder assembly having the interfitting spherical retainer halves confined within the two part zonal housing secured together by the double hinge means. In like manner, the integral foil-feeder assembly that is freely slidable axially of the jibwire is a departure from known prior art.

The patent to Hood et al, U.S. Pat. No. 3,658,025 is representative of the state of the prior art, but is concerned with a feeder and prefeeder structurally unrelated to the present invention. In addition to the above-noted distinctions from the present invention, the feeder of Hood et al is clamped on the headstay. It is neither secured to the lower end of a foil nor is it pivotal and slidably axially with respect to the headstay. Likewise the prefeeder is not secured to the headstay at a location spaced axially below the feeder and is thus not axially slidable nor universally pivotal on the headstay at that location.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 1 is a view of a sailboat embodying the present invention.

FIG. 2 is an enlarged fragmentary prespective view of the luff feeder assembly taken adjacent the line 2–2 of FIG. 1 showing the feeders, spacer, and prefeeder.

FIGS. 3, 4 and 5 are enlarged sectional views taken in the direction of the arrows essentially along the lines 3–3, 4–4 and 5–5 respectively of FIG. 2.

Figure 6:
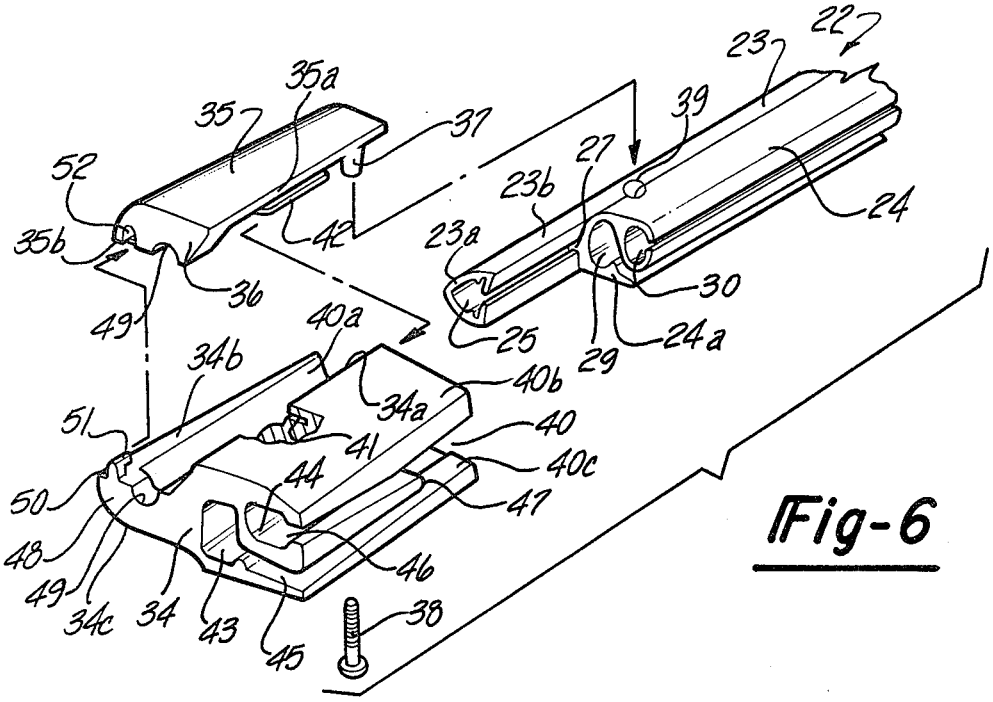
FIG. 6 is an exploded view showing the grooved foil and separate parts of the luff feeder of FIG. 2.

It is to be understood that the invention is not limited in its application to the details of construction and arrangement of parts illustrated in the accompanying drawings, since the invention is capable of other embodiments of being practiced or carried out in other similar ways. Also, it is to be understood that the phraseology or terminology employed herein is for the purpose of description and not of limitation.

DETAILED DESCRIPTION OF THE PREFERRED EMBODIMENT

Referring to FIG. 1, a sailboat embodying the present invention is illustrated having a mainsail 10, a mast 11, and a jibsail 12 supported by a jibstay, headstay or forestay 13 comprising a rod or cable that extends essentially from the bow to near the top of the mast 11. The triangular jibsail 12 is defined by its luff or luffrope 14, leach 15 and foot 16, its three jib corners comprising the upper head 17, the clew 18 at the base of the jib, and the tack 19 adjacent the bow of the boat.

The jibwire or forestay 13 may be conventionally secured at its upper end adjacent the top of the mast and at its lower end to the bow of the boat as for example by means of a conventional turnbuckle and clevis assembly 20 secured to a fitting 21. The luff 14 is supported on stay 13 by means of the foil generally designated 22, which may be fabricated from any formable and preferably extrudable material such as molded resins or metal. Materials exhibiting sufficient strength, flexibility and light weight include polyvinyls, polyacrylics, polyethylenes. Due to ease of extrusion, lightness of weight, and ease of handling after fabrication such materials are preferred over metal.

The foil 22 extends substantially the entire length of the stay 13 and comprises two interfitting elements, FIG. 3, including a stay encircling element 23 and a grooved sail supporting element 24. An opening or channel extends the entire length of the encircling element 23 and includes a headstay opening or channel 25 and a pair of lateral enlargements or slots 26. As seen in FIG. 3, an integral forward extension 27 of the grooved sail supporting element 24 substantially fills the slots 26. Its concave forward surface 28 completes the rearward boundary of headstay opening 25. Sail supporting element 24, as shown, defines a pair of generally circular rearwardly facing grooves 29, 30 which extend longitudinally for its entire length and open rearwardly from element 24 at slits 31 and 32 respectively. Each slot 31 and 32 provides a channel to accommodate a sail 12, when underway, as may be seen in FIGS. 2 and 4.

The stay 13 is smaller in diameter than opening 25 and passes freely through the opening 25 and enables the foil 22 to slide longitudinally during assembly and to pivot freely during sailing. Either or both of the grooves 29 or 30 may receive the luff rope 14 of a jibsail 12 with the jibcloth extending outwardly through the corresponding slit 31 or 32. Accordingly, while one jibsail is set, a second can be raised in the second available groove and set before the first is lowered, enabling continuous drive while changing sails. The structure of foil 22 as shown and described is similar to the commercial product marketed under the HEAD FOIL trademark by HEAD FOIL Corporation (formerly Superior Distributing Co.) Lake City, Minnesota.

Referring now to the luff feeder assembly of this invention, and particularly to FIGS. 2 and 6, the luff feeder or funnel generally designated 33 will first be described. Feeder 33 comprises a main body part 34 and a cover part 35 which assemble by a relative sliding motion in a direction parallel to their longitudinal axis, that is, along the axis of jibwire 13. Feeder 33 may be made from any weather-resistant, form-sustaining and wear-resistant material such as stainless steel, impact polystyrene, polyamides such as Nylon, polyurethanes, or the like. When assembled, body 34 and cover 35 define upwardly opening apertures or cavities 40 and **40*a***.

Cavity 40 is located entirely within body 34 and defined by the inner surfaces of top wall **40*b* and lower wall 40*c* as viewed in FIGS. 3 and 6, which are shaped to conform to and snugly receive the lower end portion of the double grooved jibsail supporting portion of element 24. Cavity 40*a* is a longitudinally extending slot, half of which is defined by the interior wall surfaces within a forward extension 34*c* of body 34 that confronts the cover 35, as may be seen at the left in FIG. 6, and the other half is defined by the interior wall surfaces within cover 35. Cavity 40*a* has the same shape as the external surface configuration of the lower end projecting portion 23*b* of jibwire encircling element 23 and nests or closely receives that projecting portion when luff feeder 33 is assembled for use, as shown in FIG. 2**.

Mating partition surfaces **34*a* and 35*a* of the body 34 and cover 35 respectively comprise parallel guideways that extend longitudinally of the stay 13 in mutually supporting sliding relationship with each other and are interlocked by means of a longitudinally extending spline slot 41 in the surface 34 closely interfitting with a mating spline 42 projecting from the surface 35*a* near the longitudinal mid-region of the cover 35**.

The approximate lower two thirds of the body 34 below cavity 40, as best seen in FIG. 6, is provided with a pair of longitudinally extending guide or funnel channels 43 and 44 which open rearwardly via slits 45 and 46 respectively. The lower ends of channels 43 and 44 are comparatively large and taper inwardly slightly and converge toward their upper end portions which align with the grooves 29 and 30 respectively. Also as is evident from FIG. 2, the channels 43 and 44 extend slightly obliquely to the stay 13 to enhance the feed angle of the luff 14 into their lower ends and thus incline forwardly from their lower ends to their upper ends which terminate at the base 47 of the recess 40 adjacent the lower end 24*a* of the element 24.

Above the base 47, the cavities 40 and 40*a* communicate with each other for reception of the joined together lower end portions of the foil elements 23 and 24. The upper end of the spline slot 41 also opens into the opening 40, so that prior to securing the screw 38, but with the cover 35 in place with its boss 37 projecting into the foil 22, the body 34 may be slid upwardly into position along the guideways or surfaces 34*a* and 35*a*, thereby to insert the spline 42 within the closely confining slot 41 and also to confine the lower end of the element 24 snugly within the cavity 40 with the end 24*a* locked into position adjacent the base 47.

Inasmuch as the foil element 24 terminates adjacent the base 47 of recess 40 when assembled with the feeder 33, the forward body portion 43*a* that defines channel 43 is substantially coextensive with the extension 23*b* and supplements the function of foil element 24 in closing the rearward opening of the headstay channel 25 and also closely engages in mutually supporting relationship the rearward exterior surfaces 26*a* of the portions of foil element 23 that define the lateral openings 26, FIG. 4. Bottom end walls 36 and 48 of the cover 35 and extension 34*c* respectively lie in the same transverse plane and cooperate form a lower cylindrical aperature 49 for freely receiving the headstay 13 upon assembly, see FIG. 2.

Projecting toward the cover 35 from the wall 48 adjacent a longitudinally extending partition surface 34*b* of the body 34 is an integral retaining pin or boss 50, FIG. 5, which terminates in an upward spline extension 51 adapted to interfit closely within a spline recess or hole 52 in the wall 36 adjacent the partition surface 35*b* of cover 35 and to overlie a portion 53 of the latter that defines the base of the recess 52, thereby interlocking the interfitted body 34 and cover 35 against relative movement except downward longitudinal sliding movement of the body 34. In the latter regard, the partition surfaces 34*b* and 35*b* are mating guideways also arranged closely adjacent each other in parallel mutually supporting sliding relationship. Although the pairs of mating guideways 34*a*, 35*a* and 34*b*, 35*b* all extend longitudinally in parallelism with each other, the parallel partition surfaces of the guideways 34*a*, 35*a* are transverse to the parallel partition surfaces of the guideways 34*b*, 35*b* and thus cooperate to block movement of the assembled body 34 and cover 35 toward each other in orthogonal directions normal to the longitudinal direction of sliding movement.

Cover part 35 is provided adjacent its upper end with a downwardly projecting boss 37 located such that it overlies and substantially bisects the region of engagement of the longitudinal edge surfaces of elements 23 and 24, see FIGS. 3 and 6. When luff feeder 33 is assembled with foil elements 23, 24, boss 37 extends into bore 39 which also extends downwardly through the walls of element 23 and through the forwardly extending tongue portion 27 of element 24. Boss 37 serves the dual purpose of interlocking elements 23 and 24 against longitudinal movement and locks luff feeder 33 to foil 22 when a fastener, shown as screw 38 is tightened through the aligned countersunk bore 39*a* in body 34 and the internally threaded bore in boss 37, FIG. 3. Thus the feeder 33 and foil 22 become an integral rigidly secured unit by use of the simple sliding engagement of the two part feeder 33 and a single fastener attachment, which steps are simply reversed for quick diassembly when desired.

By the foregoing, it will be appreciated that a compact luff feeder assembly 33 has been described comprising a minimum of closely interfitting parts that can be readily and economically manufactured and that can be replaceably assembled conveniently with the foil 22. The parts 34 and 35 may be assembled around the stay 13 by fitting the cover 35 on the lower end of the foil 22 with the lower end 23*a* adjacent the interior lower end surface of wall 36, with the boss 37 extending into bore 39 therefor in the foil 22, and with the interior surface of cover 35 flush with the adjacent exterior surface of extension 23*b*, FIGS. 3 and 6. The body 34 is then slid upwardly into place with its guide surfaces 34*a* and 34*b* in sliding and guided contact with the parallel guide surfaces 35*a* and 35*b* respectively, confining the lower end of the foil element 24 snugly within cavity 40, until the pin 50 enters the recess 52 and stops continued longitudinal movement by abutment with a portion of the cover 35 defining recess 52. The body 34 and cover 35 will then be interlocked by the splines and by the abutting guide surfaces against relative sliding, cocking or torsional movement in any direction from the assembled position, except downward when securing means 38 is not in place.

Final assembly is completed upon insertion of the single screw 38, resulting in an assembly comprising foil elements 23 and 24 and luff feeder elements 34 and 35 in completely locked together relationship. Alignment between the upper ends of the guide openings 43 and 44 with the lower ends of the foil openings 29 and 30 is thus positively maintained regardless of bending and torsional forces on the foil 22, as for example when the jibsail is set and the sailboat is underway.

Also it will be apparent in view of the present disclosure that those skilled in the art can readily modify the preferred construction described to enable assembly of a comparable feeder by relative sliding movement of its members transversely of the headstay 13.

Figure 7:
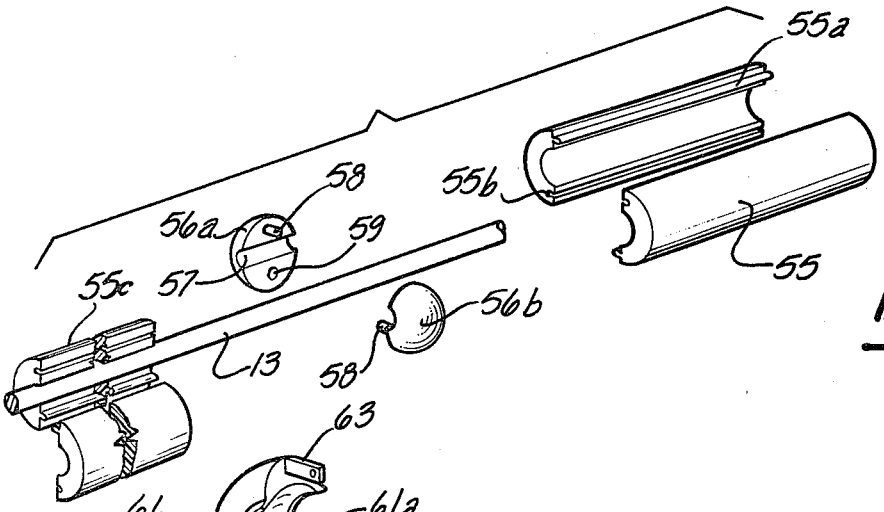
FIG. 7 is an exploded view showing separate parts of the prefeeder assembly including the spherical retainer of the prefeeder and the cylindrical spacers located respectively above and below the prefeeder.
Figure 8:
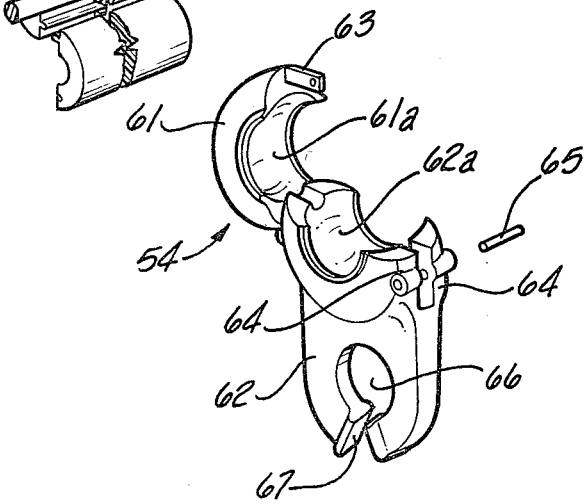
FIG. 8 is a partially exploded view showing the prefeeder housing in its open position.

Feeding the luff 14 into one or the other of the feeder grooves 43 or 44 is facilitated by means of a prefeeder assembly 54 spaced below the funnel 33 by means of a cylindrical spacer 55 around the headstay 13, FIG. 7. The spacer 55 comprises two identical longitudinal halves, each having an integral bead or spline 55*a* and a mating recess 55*b* extending longitudinally of its two diametrically spaced edges. Each bead 55*a* has a reduced thickness at its juncture with the associated edge of the spacer half and a rounded outer extremity. Each recess is similarly shaped and its sidewalls are resiliently yieldable sufficiently to enable the bead of the other spacer half to be snapped into and releasably retained therein.

Similarly, a spacer 55*c*, which may be identical to the spacer 55 except for length, spaces the assembly 54 from the lower attachment of the headway 13 to the turnbuckle 20. Thus the assembly 54 and also foil 22 with the attached feeder 33 are maintained at convenient locations above the turnbuckle 20 to facilitate feeding of the luff 14 through the guide opening 66 and into the selected feeder groove 43 or 44 without necessitating any means on the feeder 33 for gripping the stay 13 to prevent relative movement therealong.

The assembly 54 includes a two-part spherical retainer 56 separated along a diametrical plane and cooperating to provide a cylindrical diametrical bore 57 adapted to receive the headstay 13 such that it is freely slidably therein. Each of the spherical halves 56*a* and 56*b* of the sphere 56 is provided with an integral pin 58 that extends normally from the diametrical plane of separation between the two sphere halves and also provides a socket 59 mating with the pin 58 of the other sphere half, whereby the two spherical halves 56*a* and 56*b* may be interconnected as in FIG. 2 with the headstay 13 extending through the cylindrical bore 57.

The two sphere halves are retained in their interfitting spherical relationship within a two-part spherical housing comprising a cap 61, having an inner spherical surface 61*a*, and a guide 62 having a similar spherical inner surface 62*a*. The cap 61 is provided at diametrically opposite locations with a pair of hinge projections 63, each spacing a pair of hinge projections 64 of the guide 62 and connected thereto by a resilient key or hinge pin 65 extending within aligned pinholes in each of the two sets of the projections 63 and 64. Each pin 65 may be C-shaped in transverse section and slightly oversized with respect to the aligned pinholes. When the pin 65 is forced into the pinholes, it will yield resiliently and frictionally engage the sidewalls of the pinholes with sufficient force to prevent accidental disengagement yet be removable by suitable force when desired, as for example to enable replacement of a worn ball 56. The two sets of hinge type connections between the cap 61 and guide 62 are preferably identical to each other.

When the interfitting ball halves 56*a* and 56*b* are seated with the spherical socket 61*a*, 62*a* and the hinged projections 63 and 64 are connected by the spring pins 65 as described, the two part spherical retainer 56 is loosely confined and prevented from separation. In consequence the guide 62 is free for limited universal pivotal movement on the spherical retainer 56 and also for swinging around and sliding along the headstay 13 without restriction. The guide 62 is provided with a cylindrical opening 66 comparable in diameter or slightly larger than either of the openings 43 and 44 for freely receiving the luff 14 of the jibsail 12 therein and with the sailcloth extending outwardly through the V-shaped opening 67 having a plane of symmetry that also contains the principal axes of the headstay 13 and opening 66.

Accordingly the luff 14 may be fed through the opening 66 and then into one of the funnel openings 43 or 44, whereupon the sail 12 may be hoisted conventionally, as for example by means of a halyard connected within a grommet of the upper head 17, and the luff 14 will feed from its funnel opening into the associated groove 29 or 30. Although the headstay 22 and feeder or funnel 33 are each illustrated herein by way of example with two luff receiving channels, it is to be understood that either or both the headstay 22 and feeder 33 may be provided with one or more luff receiving channels and each such channel may be adapted for slidably receiving the luff of one or more sails in accordance with conventional practice.

I claim:

1. A luff feeder assembly for use in feeding the luff of a sail into a grooved foil mounted on a stay of a sailboat, comprising in combination an elongated body and an elongated cover having parallel longitudinal axes and being removably assembled together by sliding movement in the direction parallel to said axes to form a luff feeder, said body having first and second wall members defining a cavity therebetween, a first rearwardly opening groove adjacent the rearward edge surface of said first wall member extending longitudinally from the lower end surfaces of said body and essentially parallel to said longitudinal axes, a second rearwardly opening groove located forward of said first groove and extending longitudinally from the lower end surface of said body essentially parallel to said longitudinal axes, said grooves terminating at their upper ends within said cavity at a point spaced downwardly from the upper end of said wall members, said second wall member having a portion extending forwardly of said second groove and defining a portion of an elongated slot extending parallel to said first and second grooves and having a length greater than the length of said grooves, and defining a portion of a generally circular jibwire aperture for receiving a jibwire, said elongated cover being adapted to overlie said forwardly extending portion of said body and to interfit therewith to comprise a forward extension of said first wall member of said body, said cover defining the remainder of said elongated slot in said forwardly extending portion of said body, and also defining the remainder of said generally circular jibwire aperture in said body, first interengaging spline means located adjacent the side portions of said elongated cover and body, and second interengaging spline means adjacent the forward edge surface of said second wall of said body near the lower end thereof and adjacent the corresponding end of said cover, said first and said second spline means enabling relative movement of said body and said cover parallel to said longitudinal axes to assemble and interlock said body and said cover into a disassembleable unit.

2. An assembly in accordance with claim 1 wherein said cavity between said first and second wall members of said body is defined by the interior surfaces of said members contoured to correspond to the external contour of the rearward portion of the lower end of a grooved foil.

3. An assembly in accordance with claim 1 wherein said longitudinal slot defined by said forwardly extending portion of said second wall member of said body and by said overlying cover has a contour substantially corresponding to the external contour of the lower end of the forward jibwire encircling portion of a grooved foil.

4. An assembly in accordance with claim 1 wherein said cover is provided with a boss extending from the inner surface of said cover at substantially a right angle thereto at a location adjacent the upper end surface thereof and in alignment with an aperture located in said second wall member, and securing means extending through said aperture and into said boss securing said body and said cover into a disassembleable unit.

5. An assembly according to claim 1, including prefeeder means adapted to be pivotally mounted on a stay at a location spaced below said luff feeder, spacer means removably secured slidably to said stay spacing said feeder from said prefeeder means, said prefeeder means comprising a two-part spherical retainer having a diametrical bore adapted for slidable passage of said stay freely therethrough, the two parts of said retainer being separably connected along a common diametrical plane parallel to the axis of said bore and having interfitting portions for preventing relative sliding movement with respect to each other parallel to said plane, a guide having a two-part zonal housing coaxial with the diametrical bore of the retainer, the housing parts cooperating to encirle an equatorial zone of the spherical retainer, said zonal housing having an axial opening extending therethrough and a spherical interior surface universally pivotal on said spherical retainer and confining the two parts of said retainer against separation from said diametrical plane, the axial opening of said housing being oversize with respect to the transverse cross section of said stay, one part of the two-part zonal housing comprising an integral forward portion of said guide, each part of the zonal housing extending around a separate half of said equatorial zone, a pair of hinge means releasably joining the two parts of the zonal housing adjacent diametrically spaced locations respectively, a luff receiving opening extending through said guide for passage of the luff freely therethrough.

6. Prefeeder means for use in association with a luff feeder, said prefeeder means comprising a guide having a luff receiving opening extending therethrough, and means for freely pivotally mounting said prefeeder means on a jibwire, said mounting means comprising a two-part spherical retainer having a diametrical bore adapted for slidable passage of said stay freely therethrough, the two parts of the retainer being releasably interconnected adjacent a common diametrical plane, a guide having a two-part zonal housing, the housing parts cooperating to encircle on equatorial zone of the spherical retainer around the diametrical bore of the latter, said zonal housing having an axial opening extending therethrough and a spherical interior surface universally pivotal on said spherical retainer, said spherical surface confining the two parts of the retainer against separation from said diametrical plane, the axial opening of said housing being oversize with respect to the transverse cross-section of the headstay, one part of the zonal housing comprising an intergral forward portion of said guide and extending around essentially one half of said equatorial zone, the other part of the zonal housing extending around the remainder of said equatorial zone, a pair of hinge means releasably joining the two parts of the zonal housing adjacent diametrically spaced locations, each hinge means comprising overlapping portions of the two zonal housing parts having aligned pin holes extending through the aligned pin holes of each hinge means and releasably confined therein by frictional engagement with the sides of the pin holes.

7. The combination according to claim 6, the two parts of the spherical retainer being identical to each other and having confronting portions adjacent said plane and interfitting to prevent relative movement of said parts parallel to said plane, said confronting portions being releasably interfitted by movement of said parts normally to said plane toward each other.

8. A grooved foil-luff feeder assembly comprising (1) an extruded grooved foil having at least two rearwardly facing longitudinally extending grooves in a rearward portion thereof and an attached forward portion comprising a jibwire encircling portion having an aerodynamic shape defined by walls which enclose a longitudinally extending aperture for freely pivotally receiving a jibwire, and (2) a downwardly projecting end portion of said forward jibwire encircling portion projecting for a distance below said rearward portion, and (3) a luff feeder comprising in combination an elongated body member and an elongated cover member having parallel longitudinal axes and being removably assembled together by sliding movement in the direction parallel to said axes, said body member having first and second walls defining a cavity therebetween, a first rearwardly opening groove adjacent the rearward edge surface of said first wall extending longitudinally from the lower end of said body member and parallel to said longitudinal axes, a second rearwardly opening groove located forward of said first groove and extending longitudinally from the lower end of said body member parallel to said longitudinal axes, each of said first and said second grooves terminating at their upper ends within said cavity in an end wall spaced downwardly from the upper end of said first and second walls, the lower end of said grooved foil being in abutment with said end wall, said second wall having a portion extending forwardly of said second groove and defining a portion of an elongated slot parallel to said axes and having a length greater than the length of said grooves and also defining a portion of a generally circular jibway aperture for receiving a jibwire, said elongated cover member being adapted to overlie said forwardly extending portion of said body member and to interfit therewith to comprise a forward extension of said first wall of said body member, said cover member defining the remainder of said elongated slot in said forwardly extending portion of said body member, and also defining the remainder of said generally circular jibwire aperture in said body member, and the portions of said first and second walls that define said jibway aperture also comprise a bottom wall at the lower end of said elongated slot and spaced below said end wall, said downwardly projecting end portion of said jibwire encircling portion of said foil projecting into said elongated slot to adjacent said bottom wall, and a boss integral with said cover member penetrating transversely through said jibwire encircling portion and said rearward portion of said foil, and securing means extending through said second wall of said body member and into said transversely extending boss to secure said feeder and said foil into an integrated unit.

9. A luff feeder adapted to be attached to the lower end of a grooved foil for a sailboat, the combination of a body member and a cover member removably assembled together by sliding movement in one direction and cooperating at an assembled position to define a funnel having an opening for receiving the luff of a sail readily therein, the funnel opening extending upwardly through the funnel for sliding passage of the luff and terminating at an upper end adapted to be aligned with the lower end of an opening in the grooved foil, said members also defining an upwardly opening recess for snugly receiving a lower end portion of the grooved foil, said members having parallel mating guideways extending in said direction, said guideways meeting in mutually supporting sliding relationship for guiding said relative sliding movement in said direction and including separate pairs of parallel portions abutting at the assembled position for limiting relative movement of the members in orthogonal second and third directions respectively normal to said one direction, said members also having spline means interfitting at the assembled position for limiting relative movement of the members in directions opposite said second and third directions, and means passing through said recess and interengaging said members at the assembled position for interlocking the members against relative movement in either said one direction or the opposite.

10. The combination according to claim 9, one of said members having a pair of upwardly extending portions defining the recess therebetween for receiving the lower end portion of the grooved foil, said one member also having a forward extension cooperating with the other member to define a second upwardly opening recess therebetween for snugly receiving the lower end of a forward portion of the grooved foil, said members at the bottom of the second recess cooperating to define an opening for passage of a headstay freely therethrough, the second recess being located forward of the first named recess and extending below the latter, the upper openings of the two recesses being at essentially the same level.

11. The combination according to claim 9, said spline means including a boss integral with one member and extending into a mating recess in the other member, said mating recess opening in the direction opposite said one direction for receiving said boss upon relative movement of said members in said one direction, said boss having a spline projection spaced from the one member and extending in said one direction into an enlargement of said mating recess, and means for preventing relative movement of said members at the assembled position in at least one of the second and third directions by abutment with said spline projection comprising portions of said other member closely adjacent to said spline projection.

12. The combination according to claim 11, said boss extending from said one member at a location adjacent the lower edge of the latter and abutting the other member to limit said relative movement of said members in said one direction from the assembled position.

13. The combination according to claim 9, prefeed means adapted to be freely mounted on a headstay below said funnel and having a rearwardly opening luff receiving slot for slidably receiving the luff of a sail therein to facilitate feeding said luff into the lower opening of said funnel, spacer means adapted to be removably secured slidably to said headstay for spacing the funnel from the prefeed means, and second spacer means adapted to be removably secured slidably to said headstay for spacing the prefeed means from the lower attachment of the headstay with the boat, both of said spacer means being freely slidably longitudinally of the headstay and being dimensioned longitudinally to support the prefeed means and feeder at predetermined respective locations on the headstay when the feeder is assembled with a foil and the prefeeder and spacers are assembled with the headstay and the assemblies are at rest.

14. The combination of a grooved foil adapted to be carried by the headstay of a sailboat, a funnel body having a funnel opening at its lower end for receiving the luff of a sail readily therein, said funnel opening extending upwardly through the body for sliding passing of the luff and terminating at an upper end aligned with the lower end of a groove in the foil, the funnel body having a forward extension engaging and conforming closely to the contour of the forward portion of one side of the foil adjacent the lower end of the latter, the funnel body also having a pair of upward extensions defining a recess therebetween communicating with the upper end of said funnel opening and having the lower end portion of the foil rearward of said forward portion confined therein, said upward extensions conforming closely to the contours of the opposite sides respectively of said lower end portion of the foil, said funnel opening also opening rearwardly throughout the length of the funnel body for rearward passage of the sail freely from the luff, a cover confronting the forward extension of the body, the cover engaging and conforming closely to the contour of the forward portion of the side of the foil opposite said one side engaged by said forward extension, the cover and body having parallel forward guide edges in mutually supporting sliding engagement, the cover also having a trailing guide edge parallel to said forward guide edges, the body having a trailing guide edge parallel to and in mutually supporting sliding engagement with the trailing guide edge of the cover, all of said guide edges being adapted to extend in parallelism with the adjacent portion of the headstay when the body and cover are attached to the foil, interfitting spline means of the body and cover extending parallel to said guide edges at a location below said upper extension of the body and arranged to enable relative downward sliding movement of the body with respect to the cover along said guide edges for separation of the body from the cover, and means releasably interconnecting said body and cover at the region of said upper extension of the body.

15. The combination according to claim 14, the lower end of the body and cover defining a wall underlying the lower end of said forward portion of the foil and having an opening for passage of the headstay freely therethrough, said means for releasably interconnecting said body and cover comprising screw means including a boss extending from one of the members comprising said body and cover toward the other member and into a portion of the foil spacing said members, the boss having a screw threaded bore, a screw hole in said other member aligned with the screw threaded bore, and a screw extending from the exterior of the other member into said bore in screw threaded relationship.

16. The combination according to claim 14, said forward and trailing guide edges abutting to block relative movement between said body and cover in first and second orthogonal directions normal to said guide edges, said spline means including a boss integral with one of the members comprising said body and cover and extending from adjacent the lower end of said one member into a mating recess in the other member, said mating recess in the other member opening downwardly for receiving said boss therein upon relative upward sliding movement of the one member with respect to the other along said guide edges and having an upward enlargement, said boss having an upturned spline projection spaced from said one member and confined within said upward enlargement, and means for blocking relative movement between said members in directions opposite said first and second orthogonal directions respectively comprising the walls of said upward enlargement abutting said upturned spline projection.

17. The combination according to claim 16, the forward portion of the foil extending to a lower end below said end portion of the foil confined within said recess defined by said upward extensions of the body.

18. The combination according to claim 17, said trailing guide edges of the body and cover having lower portions extending downwardly beyond the recess defined by said upward extensions, said spline means also including a spline and spline slot provided respectively by said lower portions of the trailing guide edges, the spline slot extending parallel to said trailing guide edges and opening upwardly, the last named spline interfitting within the spline slot and being slidable therealong through the upper opening of the spline slot upon said relative sliding movement.

* * * * *